US005734227A

United States Patent [19]

Gotoh

[11] Patent Number: 5,734,227

[45] Date of Patent: Mar. 31, 1998

[54] INCANDESCENT LAMPS AND PROCESS FOR PRODUCING THE SAME

[75] Inventor: Hiroshi Gotoh, Shimizu, Japan

[73] Assignee: Koito Manufacturing Co., Ltd., Tokyo, Japan

[21] Appl. No.: 618,774

[22] Filed: Mar. 20, 1996

[30] Foreign Application Priority Data

Mar. 22, 1995 [JP] Japan ..... 7-087695

[51] Int. Cl.[6] ..... H01J 1/02; H01J 7/24; H01J 5/48; H01J 5/50

[52] U.S. Cl. ..... 313/578; 313/25; 313/318.08; 313/318.09

[58] Field of Search ..... 313/25, 557, 578, 313/579, 624, 225, 477 R, 491, 493, 492, 569, 318.01–318.12; 445/26, 27, 22; 220/2.2

[56] References Cited

U.S. PATENT DOCUMENTS

| | | | |
|---|---|---|---|
| 2,826,710 | 3/1958 | Lipscomb | 313/25 |
| 4,489,252 | 12/1984 | Eckhardt | 313/318.09 X |
| 4,495,436 | 1/1985 | Notelteirs | 313/318.09 X |
| 4,567,397 | 1/1986 | Wilhelm et al. | 313/318.09 X |
| 4,568,854 | 2/1986 | Westlund, Jr. et al. | 313/318.08 X |
| 4,758,760 | 7/1988 | Cox et al. | 313/318.08 X |
| 4,769,574 | 9/1988 | Nagasawa et al. | 313/318 |
| 4,785,218 | 11/1988 | Kohl et al. | 313/318.08 X |
| 5,006,088 | 4/1991 | Tokuhara et al. | 445/27 |

*Primary Examiner*—Sandra L. O'Shea
*Assistant Examiner*—Mack Haynes
*Attorney, Agent, or Firm*—Sughrue, Mion, Zinn, Macpeak & Seas, PLLC

[57] ABSTRACT

An incandescent lamp having a substantially cylindrical glass bulb closed at one end by an exhaust-sealed portion, the entire length of which is reduced by reducing the inclination of a portion continuing from the cylindrical major portion of the glass bulb to the exhaust-sealed portion, as well as, a process for producing the same. The glass bulb containing filaments is closed at one end by the exhaust-sealed portion, with a shoulder having a substantially truncated conical appearance connecting the exhaust-sealed portion and the substantially cylindrical major portion, wherein the angle formed between the plane orthogonal to the axis of the glass bulb and the surface of the shoulder, i.e. the inclination of the surface of the shoulder, is designed to be 45°or less.

1 Claim, 7 Drawing Sheets

INCANDESCENT LAMPS AND PROCESS FOR PRODUCING THE SAME

BACKGROUND OF THE INVENTION

1. Field of the Invention

The present invention relates to a novel incandescent lamp and a process for producing the same. More particularly, the present invention relates to a novel incandescent lamp having a substantially cylindrical glass bulb exhaust-sealed at one end, in which inclination of the portion continuing from the cylindrical major portion of the glass bulb to the exhaust-sealed portion is reduced so as to reduce the entire length of the glass bulb, as well as, to a process for producing the same.

2. Description of the Related Art

FIG. 8 shows one example of prior art incandescent lamp a, the glass bulb b of which has a substantially cylindrical major portion c and a substantially flat pinch-sealed portion d formed at the rear end of the major portion c, with an exhaust-sealed portion e being formed as a trace of tip-off sealing to close the front end of the major portion c.

The major portion c and the exhaust-sealed portion e are connected to each other by a substantially truncated conical portion f (hereinafter referred to as shoulder) having a gentle slope.

However, the prior art incandescent lamps a described above involve variation in the angle $\alpha$ formed between the plane orthogonal to the axis of the glass bulb b and the surface of the shoulder f, as shown in FIG. 8, and besides the angle $\alpha$ is relatively great (50° to 60°).

Accordingly, the percentage that the protrusion A corresponding to the height of the exhaust-sealed portion e plus the height of the shoulder f of the glass bulb b above the major portion c occupies the entire length B of the lamp a (including the pinch-sealed portion d and the exhaust-sealed portion e) becomes high. The entire length B of the lamp a is standardized depending on the kind of lamp.

Recently, lights, particularly vehicular lights, are required to be downsized, so that the distance between the lamp and a lens to be disposed in front of the lamp is inevitably becoming shorter.

Accordingly, if the entire length B of the lamp a is great, the distance between the lamp a and the lens of the light becomes too short, and the exhaust-sealed portion e is brought into contact with the lens in some extreme cases. Particularly when the lens is of a plastic, the heat generated from the lamp is transmitted to the lens to fuse the lens, disadvantageously.

Thus, the entire length B of the lamp a is required to be reduced. However, since the length of the major portion c occupying the greater part of the entire length B of the lamp a is also determined by the standardized positions of filaments, the major portion c cannot be shortened any further.

SUMMARY OF THE INVENTION

Therefore, with a view to solving the problems described above, in the incandescent lamp according to the present invention, the angle formed between the plane orthogonal to the axis of the glass bulb and the surface of the shoulder, i.e. the inclination of the surface of the shoulder, is designed to be 45° or less. Meanwhile, in the process for producing the incandescent lamp according to the present invention, a glass tube is heated and drawn at the middle portion to form a neck, and then the shoulder of the thus necked glass tube is reshaped by heating such that the angle formed between the plane orthogonal to the axis of the glass tube and the surface of the shoulder, i.e. the inclination of the surface of the shoulder, may be 45° or less.

According to the present invention, the protrusion corresponding to the height of the exhaust-sealed portion plus the height of the shoulder above the major portion of the glass bulb can be minimized, so that the entire length of the incandescent lamp can be reduced, leading to downsizing of the light.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiment taken in conjunction with the accompanying drawings in which:

FIGS. 1 to 7 show the incandescent lamp according to one embodiment of the present invention embodied in a tungsten halogen lamp and a process for producing the same; in which:

FIG. 1 shows in side view the tungsten halogen lamp;

FIG. 2 shows in enlarged cross-sectional view the major portion of the lamp shown in FIG. 1;

FIG. 3 is a view schematically showing a step of forming the neck;

FIG. 4 is a view showing a state where pinch sealing is completed;

FIG. 5 is a view showing a step of reshaping the shoulder;

FIG. 6 is a view showing a cooling step;

FIG. 7 is a view showing a tip-off sealing step; and

DETAILED DESCRIPTION OF THE PREFERRED EMBODIMENT

Figure 1:
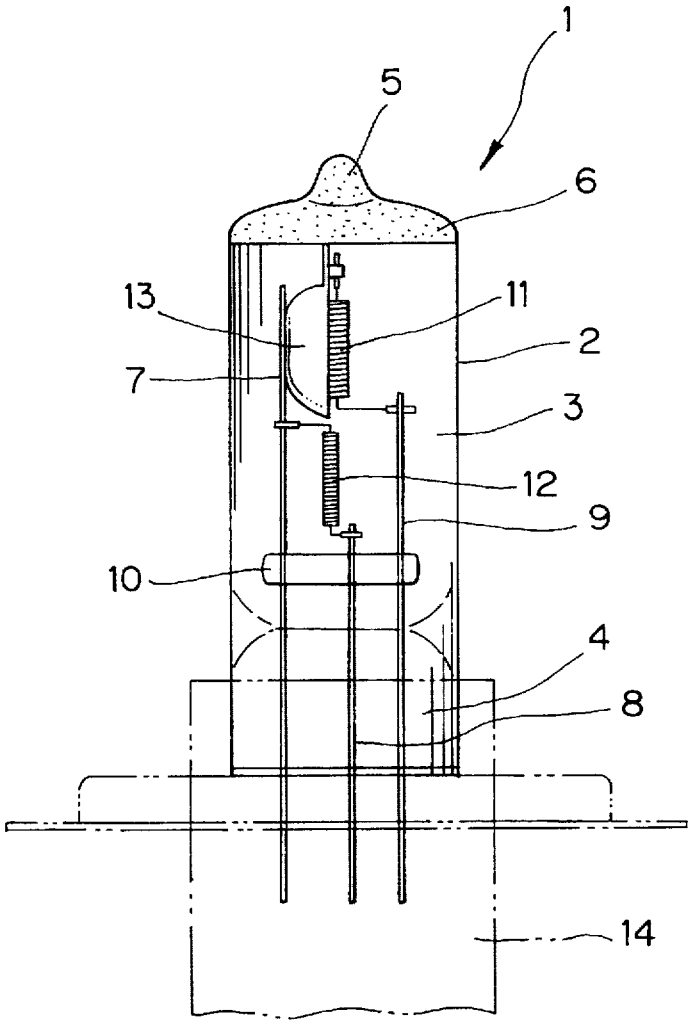

The incandescent lamp and the process for producing the same according to the present invention will be described in detail by way of a preferred embodiment referring to the attached drawings.

FIGS. 1 to 7 show an embodiment of incandescent lamp and a process for producing the same embodied in a so-called H4 type tungsten halogen lamp and a process for producing the same.

A glass bulb 2 of a tungsten halogen lamp 1 has a substantially cylindrical major portion 3 and a substantially flat pinch-sealed portion 4 formed at the rear end of the major portion 3, with a conical exhaust-sealed portion 5 protruding as a trace of tip-off sealing to close the front end of the major portion 3.

A shoulder 6 is present between the major portion 3 and the exhaust-sealed portion 5 to connect these portions 3 and 5. The shoulder 6 has a substantially conical shape with an inclination gentler than in the exhaust-sealed portion 5.

Lead wires 7, 8, 9, penetrate the pinch-sealed portion 4 and are retained at the middle by that portion 4. The parts *7a*, *8a*, *9a*, of the lead wires 7, 8, 9, in the glass bulb 2 are referred to as inner lead wires, whereas the parts *7b*,*8b*,*9b* protruding outward from the pinch-sealed portion 4 are referred to as outer lead wires.

A pair of glass bridges 10 hold between them the inner lead wires *7a*, *8a*, *9a*, in the glass bulb 2 at a position closer to the pinch-sealed portion 4 and are fused together.

Figure 5:
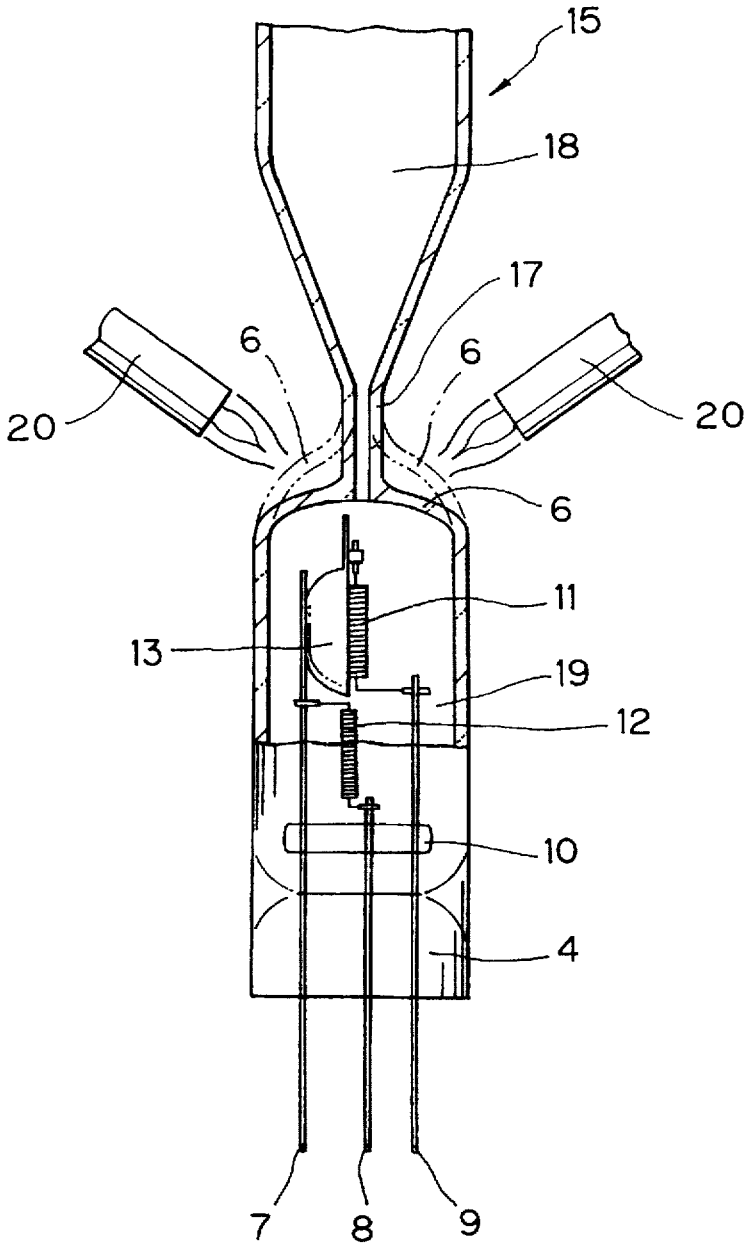

The reference numbers 11 and 12 denote filaments, and 13 a shade cap. As shown in FIGS. 1 and 5, the shade cap 13 is secured at the bottom to the lead wire 7 by means of spot welding and the like so that the lower half of the filament 11 may be substantially covered with the shade cap 13. The filament 11 is situated between the shade cap 13 and the lead wire 9 to be parallel with the lead wires 7, 8, 9, whereas the filament 12 is situated between the lead wires 7 and 8 to be parallel with them. The filament 11 is for so-called low beam application, and the filament 12 is for so-called high beam application.

Incidentally, a base 14, detailed description of which will be omitted here, holds the thus constituted glass bulb 2 and serves to regulate the position of the tungsten halogen lamp 1 when the lamp 1 is incorporated into a light.

The process for producing such tungsten halogen lamp 1 will be described briefly referring to FIGS. 3 to 7.

Figure 3:
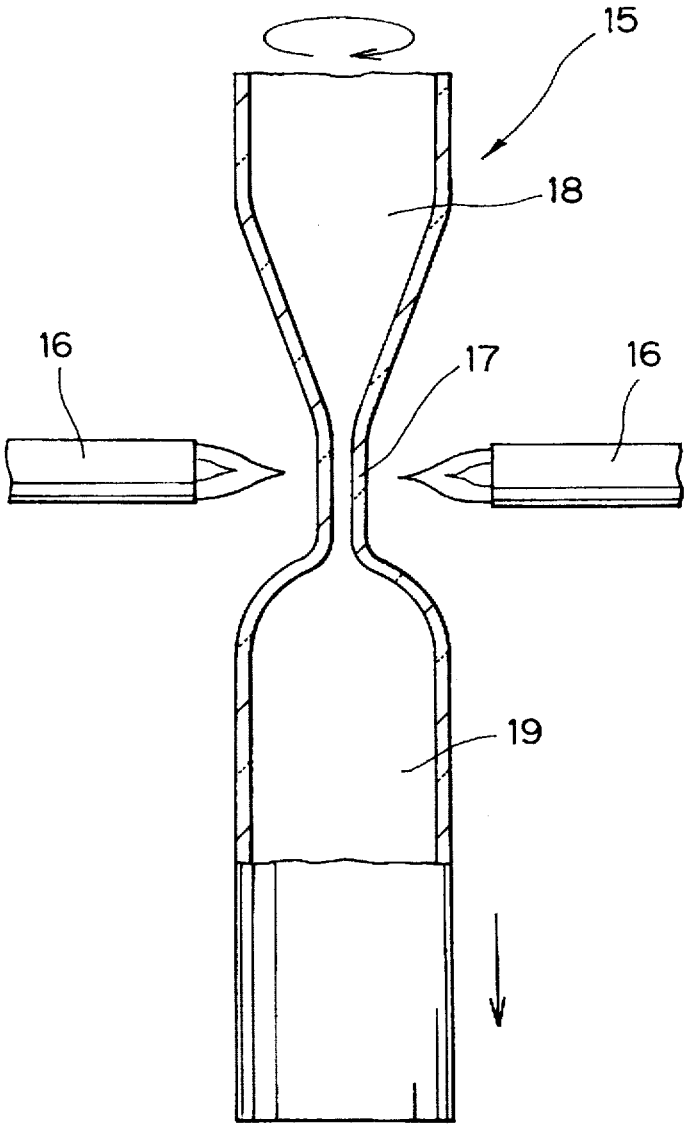

First, a crude glass tube 15 having a substantially cylindrical shape is heated at the middle with burners 16 under rotation of the tube 15 in a certain direction. When the tube 15 is softened enough, the lower end portion of the crude glass tube 15 immobilized at the upper end portion is pulled down, or the lower portion of the glass tube 15 is allowed to fall by the self-weight to draw the crude glass tube 15 at the softened middle portion and fork a neck 17 having a diameter smaller than other portions, as shown in FIG. 3. The crude glass tube 15 is divided by the neck 17 into two parts, i.e. an upper half 18 and a lower half 19 which is utilized as the glass bulb 2 of the tungsten halogen lamp 1.

Figure 4:
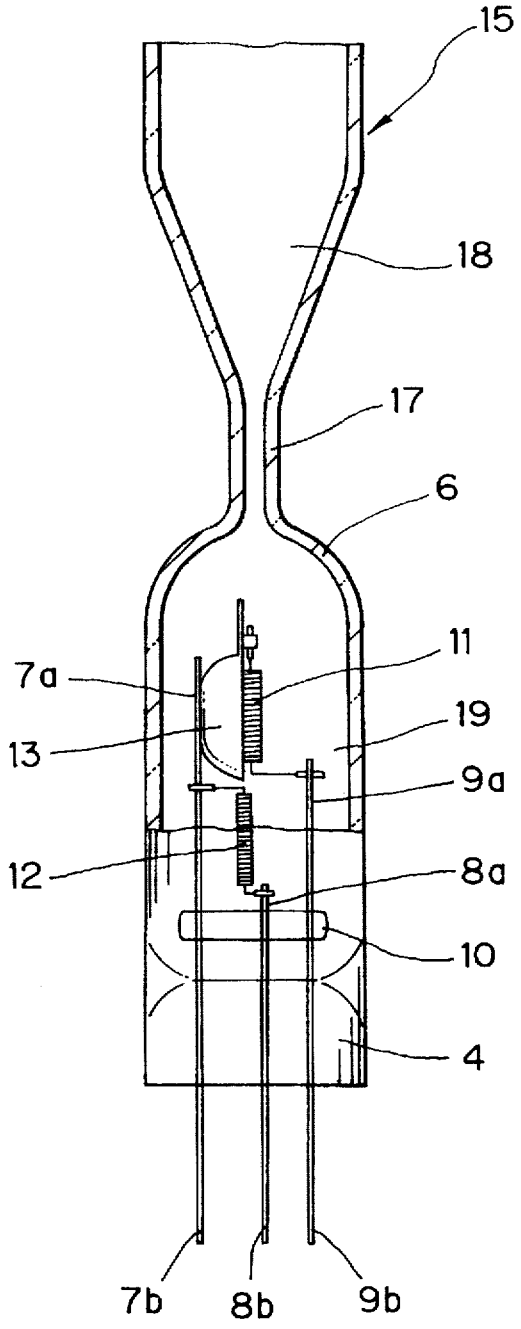

Next, the lead wires 7, 8, 9,, across which the filaments 11, 12 are extended, are inserted beforehand to the lower half 19 of the crude glass tube 15. In this state, the lower end portion of the lower half 19 is softened by heating with a burner (not shown). When the lower end portion is softened enough, that portion is squeezed with a pair of pincers to form the pinch-sealed portion 4, as shown in FIG. 4.

Before the tip-off sealing step is started, the shoulder 6 of the glass bulb 2 is reshaped by heating with burners 20, as shown in FIG. 5. More specifically, for example, the lower half 19 of the crude glass tube 15 is pulled up with the upper half 18 being immobilized, otherwise, the upper half 18 is pulled down to reshape the softened shoulder 6 assuming the state depicted by the two-dot chain line to the state depicted by the solid line.

The glass bulb 2 is then cooled timely with air blowing and the like such that the shoulder 6 may have an optimum shape as will be described later.

Figure 2:
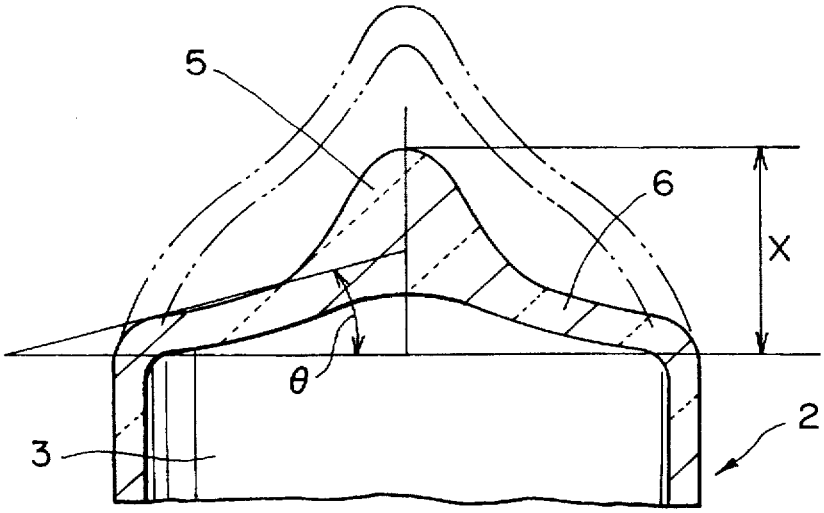

By regulating the cooling timing properly, the angle θ formed between the plane orthogonal to the axis of the glass bulb 2 and the surface of the shoulder 6, i.e. the inclination of the surface of the shoulder 6, as shown in FIG. 2, can be included within a desired range.

More specifically, if the cooling timing is too early, the inclination θ becomes large to increase the protrusion X corresponding to the height of the exhaust-sealed portion 5 plus the height of the shoulder 6 above the major portion 3; whereas if the cooling timing is too late, the inclination θ becomes small to reduce the protrusion X. However, the shoulder 6 is flattened awkwardly to have a nonuniform wall thickness, and thus the glass is warped to readily cause cracking or sinking of the exhaust-sealed portion 5 and shoulder 6 into the major portion 3, giving a defective lamp. Accordingly, cooling must be carried out so as to secure an inclination θ which can reduce the protrusion X with no problems as described above.

The present inventors made experiments to find that the optimum inclination θ is between and including 10° and 20°.

More specifically, if the inclination θ is less than 10°, the diameter of the crude glass tube 15 is reduced sharply from the lower half 19 (diameter: ca. 16 mm) to be utilized as the glass bulb 2 of the tungsten halogen lamp 1 toward the neck 17 (diameter: ca. 3 mm), so that a great distortion occurs at the shoulder 6, when the shoulder 6 is softened and reshaped, to lower the strength of the shoulder 6 significantly. On the other hand, when the inclination θ is more than 20°, variation is likely to occur in the length of the neck 17 in the so-called tip-off sealing step where the lower half 19 is separated from the upper half 18, in turn, in the size (protrusion or height of the exhaust-sealed portion 5) of the tungsten halogen lamps 1 as final products. Incidentally, if tungsten halogen lamps 1 of a uniform size are to be produced irrespective of the length of the neck 17 where such variation is likely to occur, the tip-off point must be set up for each bulb, but such method is not practical since it involves inconveniences such that the production cost rises.

Accordingly, when the inclination θ of the shoulder 6 is within the range of 10° to 20°, the protrusion X can be minimized with no problems as described above, and tungsten halogen lamps 1 with stable length and quality can be obtained.

Meanwhile, referring to the relationship between the inclination θ and the protrusion X, while the protrusion X is the total length of the height of the exhaust-sealed portion 5 plus the height of the shoulder 6, the protrusion X is increased or decreased depending on the height of the shoulder 6, because the height of the exhaust-sealed portion 5 is substantially constant irrespective of the inclination θ of the shoulder 6.

Since the height of the shoulder 6 is expressed by tanθ, there is established a relationship that the smaller the inclination θ is, the smaller becomes the protrusion X. In other words, the protrusion X is substantially proportional to the inclination q of the shoulder 6.

Incidentally, the protrusion X when the inclination θ of the shoulder 6 is between 10° and 20° is at most about ⅓ as long as in the case of the prior art tungsten halogen lamp where the inclination θ of the shoulder is 50° to 60°.

Figure 6:
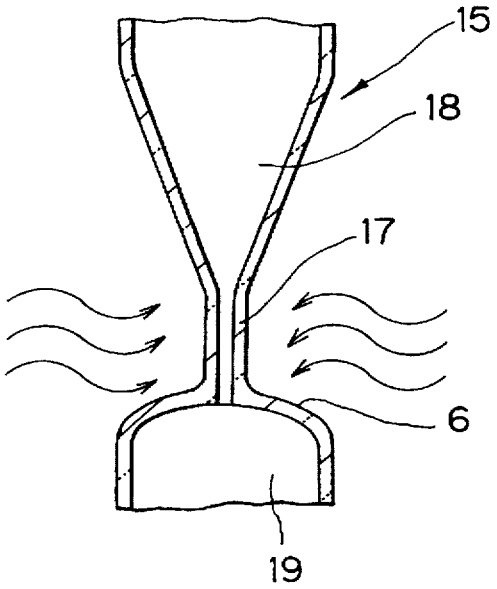
Figure 7:
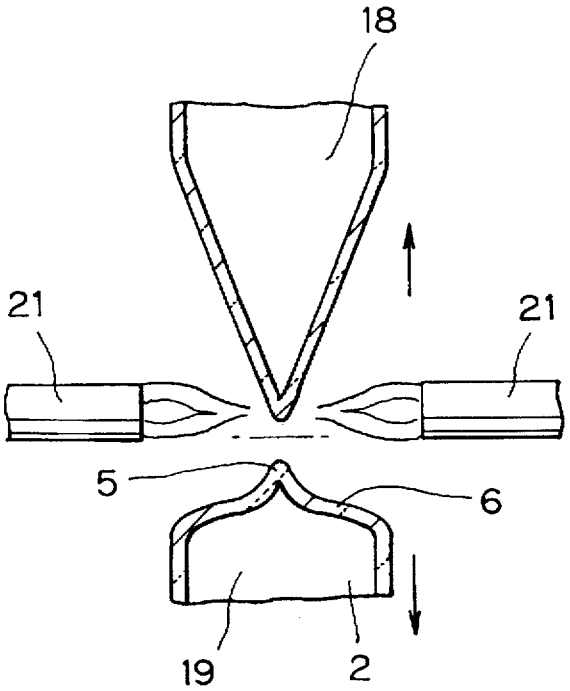
Figure 8:
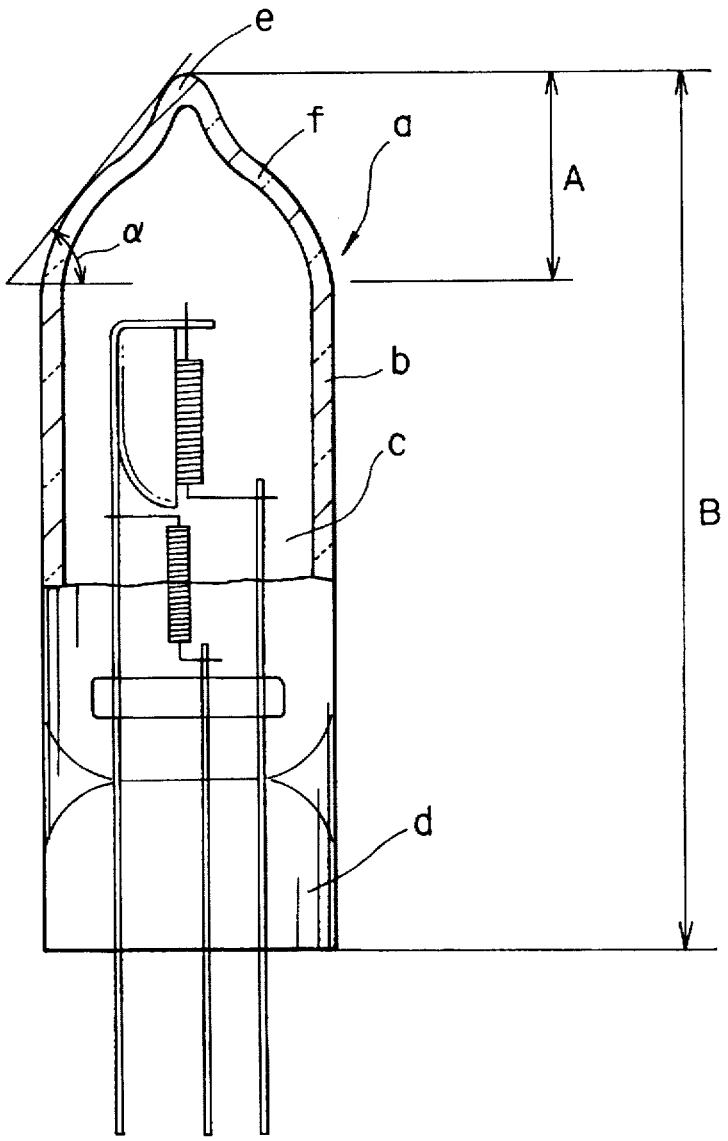
Fig. 8 Prior Art
FIG. 8 shows in enlarged cross-sectional view a prior art incandescent lamp.

After completion of the step of reshaping the shoulder 6, the cooling step follows as shown in FIG. 6. Then, the lower half 19 of the crude glass tube 15 is evacuated and cleaned through the neck 17, and charged with a filler gas from the upper opening of the upper half 18 through the neck 17. The boundary between the lower half 19 and the neck 17 is softened by heating with burners 21 to draw off the lower half 19 of the crude glass tube 15 at the thus softened portion and to close the lower half 19 simultaneously, as shown in FIG. 7. This is the so-called tip-off sealing step, where the exhaust-sealed portion 5 is formed in the form of protrusion at the front end of the tungsten halogen lamp 1.

As is clear from the above description, the incandescent lamp according to the present invention in which a substantially cylindrical glass bulb containing filaments is closed at one end by an exhaust-sealed portion, with a shoulder having a substantially truncated conical appearance connecting the exhaust-sealed portion and the substantially cylindrical major portion, is characterized in that the angle formed between the plane orthogonal to the axis of the glass bulb and the surface of the shoulder, i.e. the inclination of the surface of the shoulder, is designed to be 45° or less. Meanwhile, the process for producing the incandescent lamp according to the present invention in which a substantially cylindrical glass bulb containing filaments is closed at one end by an exhaust-sealed portion, with a shoulder having a substantially truncated conical appearance connecting the exhaust-sealed portion and the substantially cylindrical major portion, is characterized in that a glass tube is heated and drawn at the middle portion to form a neck, the shoulder of the thus necked glass tube is reshaped by heating such that the angle formed between the plane orthogonal to the axis of the glass tube and the surface of the shoulder, i.e. the inclination of the surface of the shoulder, may be 45° or less.

Thus, according to the present invention, since the protrusion corresponding to the height of the exhaust-sealed portion plus the height of the shoulder above the major portion of the glass bulb can be minimized, the entire length of the incandescent lamp can be reduced, leading to downsizing of the light.

The shapes and structures of the respective parts typically shown in the foregoing embodiment are to be considered as illustrative and not restrictive, and the present invention is not to be limited to the technical details given herein, but may be modified within the scope of the appended claims.

What is claimed is:

1. An incandescent lamp comprising:

a substantially cylindrical glass bulb containing filaments, said bulb being closed at one end by an exhaust-sealed portion formed by a tip-off sealing step in a process for producing the incandescent lamp, and having a substantially cylindrical major portion and a shoulder, said shoulder having a substantially truncated conical appearance, said shoulder connecting said exhaust-sealed portion and said substantially cylindrical major portion, wherein an angle formed between a plane orthogonal to a longitudinal axis of said glass bulb and said shoulder is between 10° and 20°.

* * * * *